US010561882B2

(12) United States Patent
Baek et al.

(10) Patent No.: US 10,561,882 B2
(45) Date of Patent: Feb. 18, 2020

(54) ELECTRIC EXERCISE ASSISTANCE DEVICE

(71) Applicant: Jun Young Baek, Busan (KR)

(72) Inventors: Jun Young Baek, Busan (KR); Chi Beom Noh, Busan (KR); Sung Min Yoon, Busan (KR)

(73) Assignee: Jun Young Baek, Busan (KR)

( * ) Notice: Subject to any disclaimer, the term of this patent is extended or adjusted under 35 U.S.C. 154(b) by 126 days.

(21) Appl. No.: 15/766,031

(22) PCT Filed: Oct. 14, 2016

(86) PCT No.: PCT/KR2016/011517
§ 371 (c)(1),
(2) Date: Apr. 5, 2018

(87) PCT Pub. No.: WO2017/065538
PCT Pub. Date: Apr. 20, 2017

(65) Prior Publication Data

US 2018/0290001 A1 Oct. 11, 2018

(30) Foreign Application Priority Data

Oct. 15, 2015 (KR) ..... 10-2015-0144087

(51) Int. Cl.
*A63B 21/005* (2006.01)
*A63B 21/072* (2006.01)
*A63B 21/078* (2006.01)

(52) U.S. Cl.
CPC ..... *A63B 21/005* (2013.01); *A63B 21/072* (2013.01); *A63B 21/0783* (2015.10)

(58) Field of Classification Search
CPC . A63B 21/005; A63B 21/0783; A63B 21/072; A63B 17/04; A63B 71/0036;
(Continued)

(56) References Cited

U.S. PATENT DOCUMENTS

2012/0058859 A1* 3/2012 Elsom-Cook .... A63B 21/00181 482/4
2013/0190143 A1* 7/2013 Greenhill ..... A63B 21/0058 482/104
(Continued)

FOREIGN PATENT DOCUMENTS

JP 07-241354 A 9/1995
JP 2011-251067 A 12/2011
(Continued)

*Primary Examiner* — Sundhara M Ganesan
(74) *Attorney, Agent, or Firm* — IP Legal Services, LLC

(57) ABSTRACT

The present invention relates to an exercise assistance device for assisting muscle exercise by means of a motor driven by means of electronic control. An electric exercise assistance device, according to the present invention, comprises: sensors comprising a first sensor and a second sensor; a motor driven by means of a control signal and generating an external force; a Micom for correcting the frictional driving force inside an exercise assistance device and deriving a calculation value of exercise assistance point, exercise assistance intensity and exercise assistance location on the basis of an encoder signal, the exercise speed and the number of exercise sets detected by means of the first sensor, exercise intensity, and user information; a mount detachably attached to a vertical frame of a rack used for muscle exercise; a base rail for guiding the movement of a safety bar; a power transmission unit for transmitting the power of the motor to the safety bar; the safety bar for enabling application of an external force, which is required for exercise assistance and exercise, and enabling detachment and attachment of a barbell rod for muscle exercise; and a rest for resting a weight material, used for muscle exercise, at an exercise starting location.

8 Claims, 11 Drawing Sheets

(58) Field of Classification Search
CPC ..... A63B 21/0058; A63B 24/0087; A63B 2024/0093; A63B 21/00181; A63B 21/078
See application file for complete search history.

(56) References Cited

U.S. PATENT DOCUMENTS

| | | | | |
|---|---|---|---|---|
| 2014/0228175 | A1* | 8/2014 | Lemos | A63B 21/00076 482/5 |
| 2014/0296040 | A1* | 10/2014 | Mobley | A63B 21/078 482/104 |
| 2016/0151675 | A1* | 6/2016 | Chazalon | A63B 21/0053 482/5 |

FOREIGN PATENT DOCUMENTS

| | | | |
|---|---|---|---|
| KR | 10-0657716 | B1 | 12/2006 |
| KR | 10-1315518 | B1 | 10/2013 |
| KR | 10-2014-0124161 | A | 10/2014 |

* cited by examiner

ELECTRIC EXERCISE ASSISTANCE DEVICE

CROSS REFERENCE TO RELATED APPLICATIONS

This application is a National Stage patent application of PCT International Patent Application No. PCT/KR2016/011517 (filed on Oct. 14, 2016) under 35 U.S.C. § 371, which claims priority to Korean Patent Application No. 10-2015-0144087 (filed on Oct. 15, 2015), the teachings of which are incorporated herein in their entireties by reference.

TECHNICAL FIELD

The present invention relates to an exercise spotting device for assisting muscular strength exercises, and more particularly, to an exercise spotting device for assisting muscular strength exercises with a motor driven by electronic control.

BACKGROUND ART

Weight training is a typical type of anaerobic exercise for strengthening muscular strength by lifting heavy weights to stimulate muscles. As interest in health and shape increases, weight training is becoming a popular trend.

In order to do weight training, heavy weights such as barbell bars, barbell discs, dumbbells, etc. are required. For more systematic training, a rack in which the heavy weights can be stored by weight and some of the heavy weights can be placed at the starting position for exercise is further required. The rack can be classified into a power rack, a half rack, a multi rack, etc. Since these racks are products of which basic functions and configurations themselves are simple, although their forms are slightly different by type, the overall functions and configurations are practically the same. However, since the racks are relatively expensive products and hardly cause problems such as a breakdown, etc., they are used for a long period of time once installed.

Conventionally, a number of techniques have been disclosed for assisting or performing muscular strength exercises such as weight training, etc. in an electrically-powered manner. The conventional arts are based on a rack-like external appearance and housing for weight training and configured by adding additional elements inside and outside the rack. However, as described above, the rack for weight training are expensive and have the feature of being used for a long period of time. In order to have the muscular strength exercises receive assistance in an electric-powered manner, a costly problem arises because the existing rack have to be replaced with an apparatus to which one of the above techniques has been applied.

In addition, the muscular strength exercises such as weight training, etc. should be continued in a state of muscle fatigue by continuously stimulating muscles to see the effects of the exercises. However, the muscles with accumulated fatigue become sensitive to the change of a minute external force. Therefore, the effects of the exercises can be increased or decreased depending on the minute intensity of the external force transmitted from the electric spotting apparatus. However, since the conventional arts apply a simple algorithm that only accepts information via an external sensor, and do not take into account minute force changes such as information about a reaction force, etc. generated by exercise and a frictional force generated in the apparatus itself, they could not provide a training spotting system suitable for a sensitive reaction that muscles exhibit in a fatigue state.

In addition, the conventional arts have been developed only for one function of the muscular strength exercise using heavy weights or the muscular strength exercises using a load generated by an electric actuating power, so there is no exercises spotting apparatus capable of performing two kinds of the above exercises at the same time.

DISCLOSURE

Technical Problem

Therefore, the electric exercise spotting device according to the embodiment of the present invention can be installed in addition to the rack for weight training.

Further, the electric exercise spotting device according to the embodiment of the present invention is suitable for a sensitive reaction that muscles exhibit in a fatigue state.

In addition, the electric exercise spotting device according to the embodiment of the present invention can perform and assist both of the muscular strength exercises using the heavy weights and the muscular strength exercises using the load generated by the electric actuating power.

Technical Solution

In an electric exercise spotting device for assisting muscular strength exercises, provided with a safety bar driven by a motor for exercise spotting, the electric exercise spotting device according to an embodiment of the present invention includes: sensors including a first sensor for detecting the number of times of exercise and an exercise speed, and a second sensor for detecting that the safety bar approaches an object; a motor, driven by a control signal, for generating an external force and transmitting an encoder signal; a microcomputer for deriving calculation values of an exercise spotting point, an exercise spotting intensity, and an exercise spotting position on the basis of user information and an exercise intensity, the number of times of exercise and an exercise speed detected by the first sensor, and an encoder signal by correcting a driving frictional force inside the exercise spotting device, for calculating an external force value to be generated by the motor based on the calculation values, and for sending out a control signal to the motor; a mount detachably attached to a vertical frame of a rack used for the muscular strength exercises; a base rail, fixed parallel to the mount, for guiding movement of the safety bar; a power transmission unit, positioned inside the base rail, for transmitting the power of the motor to the safety bar; the safety bar for application of the external force, which is required for exercise spotting and exercise, by receiving the power generated from the motor, and for enabling detachment and attachment of a barbell bar for the muscular strength exercises; and a rest, fixed to the mount or the base rail in a locking manner, for resting heavy weights, used for the muscular strength exercises, at an exercise starting position.

In addition, the mount of the electric exercise spotting device according to one aspect of the present invention includes: a rod-shaped mounting pin which is installed through the vertical frame of the rack used for the muscular strength exercises; a first mount in the shape of a U-beam provided with a first locking groove with which the mounting pin is engaged and a rest groove with which the rest is engaged; and a second mount in the shape of a U-beam to which the base rail is fixed and provided with a second locking groove with which the mounting pin is engaged.

In addition, the base rail of the electric exercise spotting device according to the aspect of the present invention is formed in the shape of a rectangular tube with a rail groove for guiding the movement of the safety bar vertically formed on the front surface.

In addition, the power transmission unit of the electric exercise spotting device according to one aspect of the present invention includes: a motor connector, connected to a drive shaft of the motor, for initially receiving the power of the motor; a belt for transmitting the power transmitted to the motor connector to the safety bar; a safety bar connector fixed on the belt and coupled with the safety bar; pulleys, positioned at upper and lower portions of the belt for stabilizing the driving of the belt; a weight balancer, fixed on the belt, for smoothing the driving of the belt and the motor by canceling out a weight of the safety bar by its own weight and an external force by the exercise spotting and its own weight; and a weight balancer rail installed in a direction parallel to the belt for guiding movement of the weight balancer.

In addition, the power transmission unit of the electric exercise spotting device according to another aspect of the present invention includes: a motor connector, connected to a drive shaft of the motor, for initially receiving the power of the motor; a ball screw, vertically connected to the motor connector, for being rotated according to the driving of the motor; a ball screw nut positioned on the threads of the ball screw and engaged with the safety bar; and rotation supports positioned upper and lower parts of the ball screw to form a rotation axis of the ball screw.

In addition, the safety bar of the electric exercise spotting device according to the aspect of the present invention includes: a safety bar main body, coupled to the power transmission unit, for receiving the power of the motor and for transmitting an external force by the muscle strength exercise to the power transmission unit and the motor, and having a rectangular tubular shape with an upper side thereof being cut out to have a safety bar cap fixing groove; a safety bar cap capable of being detachably attachable to the safety bar cap fixing groove and provided with a bar fixing groove in which the barbell bar used for the muscular strength exercises is seated thereunder; and an impact-reducing material, installed on a upper surface of the safety bar for reducing impact generated when the safety bar touches a heavy weight used for the muscular strength exercises, thereby performing both of the muscular strength exercises using the heavy weight and the muscular strength exercises using the power of the motor.

In addition, the safety bar of the electric exercise spotting device according to the aspect of the present invention further includes a barbell bar rest groove, in the shape of a groove, into which the barbell bar is inserted such that the barbell bar is not moved on the safety bar, and performs a lift function for moving the heavy weight used for the muscular strength exercises to an exercise starting position for each type of muscular strength exercises.

In addition, the rest of the electric exercise spotting device according to the aspect of the present invention includes: a frame latching portion for fixing the rest to the mount or the base rail in a latching manner; a barbell rest provided with a mounting groove on which the barbell bar is rested; and an one-way hinge for allowing vertical rotation of the barbell rest with respect to the frame fixing portion, the one-way hinge being rotatable in an upward direction and restricted to rotate in a downward direction by a hinge stop.

In addition, the second sensor of the electric exercise spotting device according to the aspect of the present invention is fixed to the safety bar to detect the approach of an upper side surface of the safety bar to the object, whereby when the upper side surface of the safety bar approaches the object, the moving speed of the safety bar is reduced.

In addition, the microcomputer of the electric exercise spotting device according to the aspect of the present invention, not only calculates the external force value to be generated by the motor to assist the muscular strength exercises using the heavy weight, but also, after the barbell bar is rested and fixed between the safety bar main body and the safety bar cap, calculates the external force value to be generated by the motor to assist the muscular strength exercises being performed against a load for the muscular strength exercises, the load generated in the barbell bar by the power of the motor.

Advantageous Effects

Therefore, the electric exercise spotting device according to the embodiment of the present invention can be installed in addition to the rack for weight training.

Further, the electric exercise spotting device according to the embodiment of the present invention is suitable for a sensitive reaction that muscles exhibit in a fatigue state.

In addition, the electric exercise spotting device according to the embodiment of the present invention can perform and assist both of the muscular strength exercises using the heavy weights and the muscular strength exercises using the load generated by the electric actuating power.

The effects of the present invention are not limited to those mentioned above, and other problems not mentioned can be clearly understood by those skilled in the art from the following description.

BEST MODE

Figure 1:
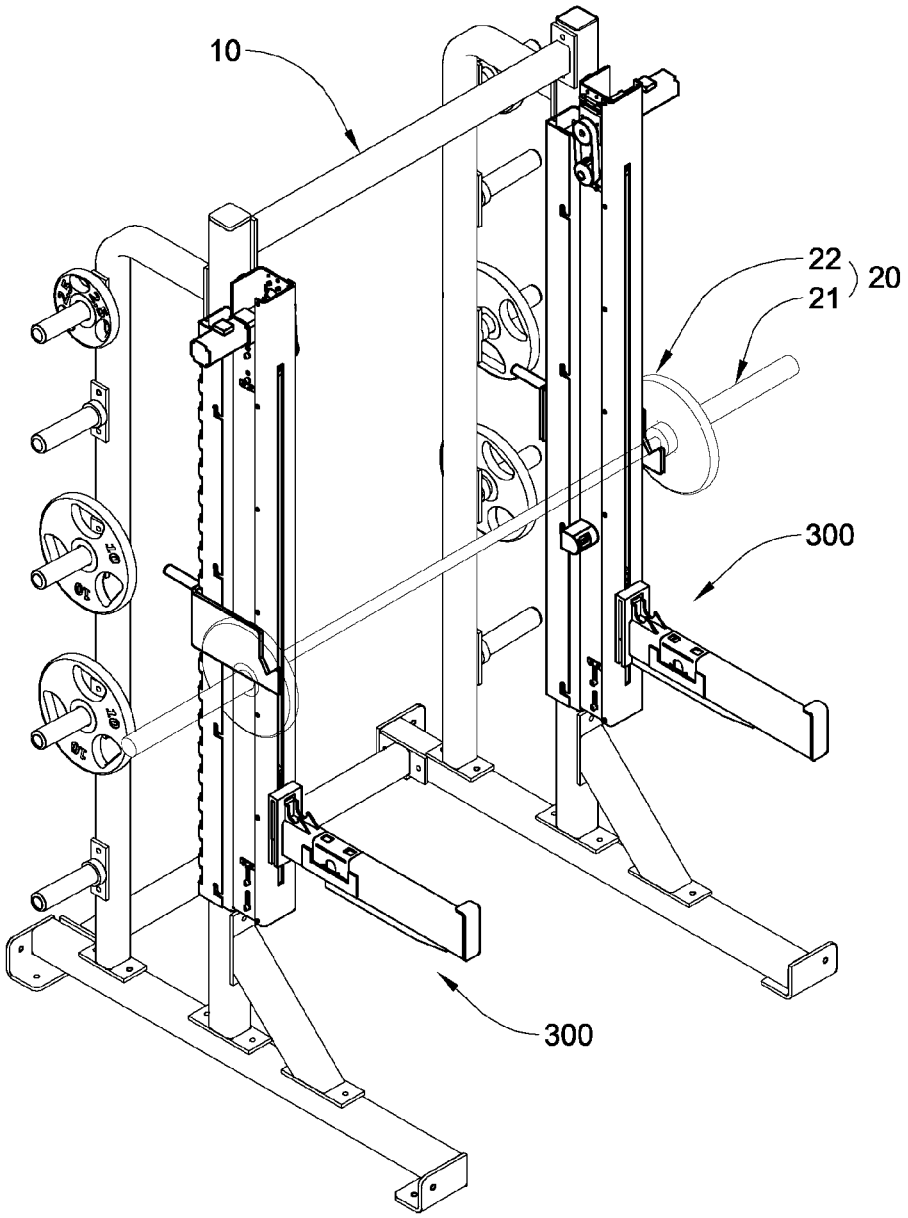
FIG. 1 is a perspective view showing that an electric exercise spotting device according to an embodiment of the present invention is attached to a rack for muscular strength exercises.

Before describing embodiments of the present invention, it should be understood that various changes and modifications and addition of components to the following embodiments are possible for the present invention within the scope as defined in claims, and that the following embodiments are not intended to limit the present invention to the specific embodiments, but that present invention includes all changes, modifications, equivalents, and alternatives that fall within the scope defined in claims.

When an element is referred to as being "connected" or "joined" to the other element, it is to be understood that it may be directly connected or joined to the other element, but there is another element therebetween. On the other hand, when an element is referred to as being "directly connected" or "directly joined" to the other element, it should be understood that there is no other element therebetween.

The terminology used herein is for the purpose of describing only a specific embodiment, and is not intended to limit the invention. The singular expression includes the plural expression unless the context clearly indicates otherwise. In the present application, the term "comprise" or "have" is used to specify that a feature, a number, a step, an operation, an element, a component, or a combination thereof described in the specification exists, but do not preclude the probability of presence or addition of one or more other features, numbers, steps, operations, elements, components, parts, or combinations thereof.

In addition, terms such as " . . . part," " . . . unit," " . . . module," etc., which are described in the specification, mean a unit for a comprehensive configuration that performs at least one function or operation, which may be implemented by hardware, software, or a combination of hardware and software.

In addition, in the following description with reference to the accompanying drawings, the same components are denoted by the same reference numerals regardless of the drawing numerals, and a duplicate description thereof will be omitted. In describing the present invention, if a detailed description of related well-known arts obscures the gist of the present invention unnecessarily, the detailed description thereof will be omitted.

Hereinafter, embodiments of the present invention will be described in detail with reference to the accompanying drawings.

Figure 2:
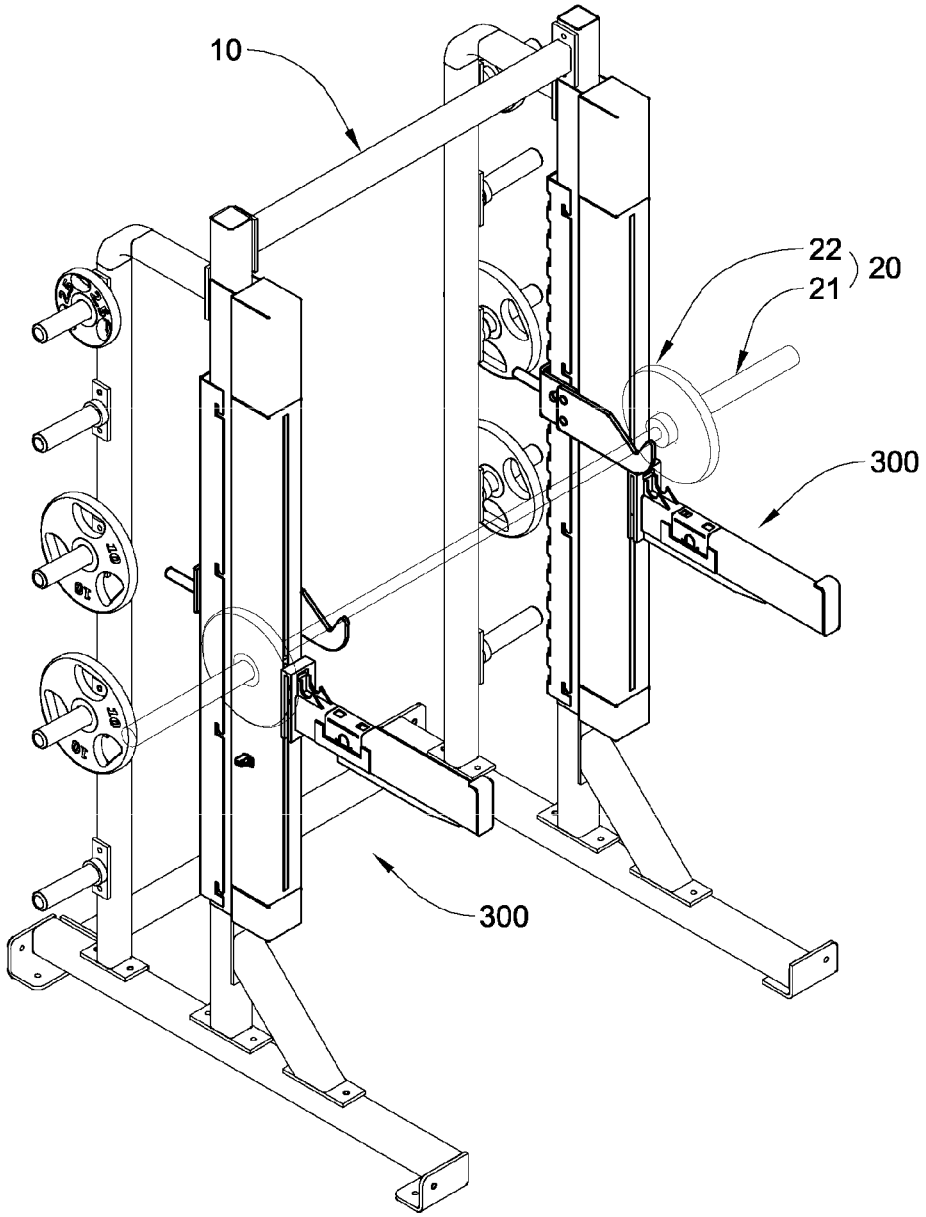
FIG. 2 is a perspective view showing that an electric exercise spotting device according to another embodiment of the present invention is attached to a rack for muscular strength exercises.

FIG. 1 is a perspective view showing that an electric exercise spotting device according to an embodiment of the present invention is attached to a rack for muscular strength exercises, FIG. 2 is a perspective view showing that an electric exercise spotting device according to another embodiment of the present invention is attached to a rack for muscular strength exercises.

As shown in FIGS. 1 and 2, an electric exercise spotting device 300 according to the embodiment of the present invention is attachable to a vertical frame of the rack 10 used for muscular strength exercises.

Figure 3:
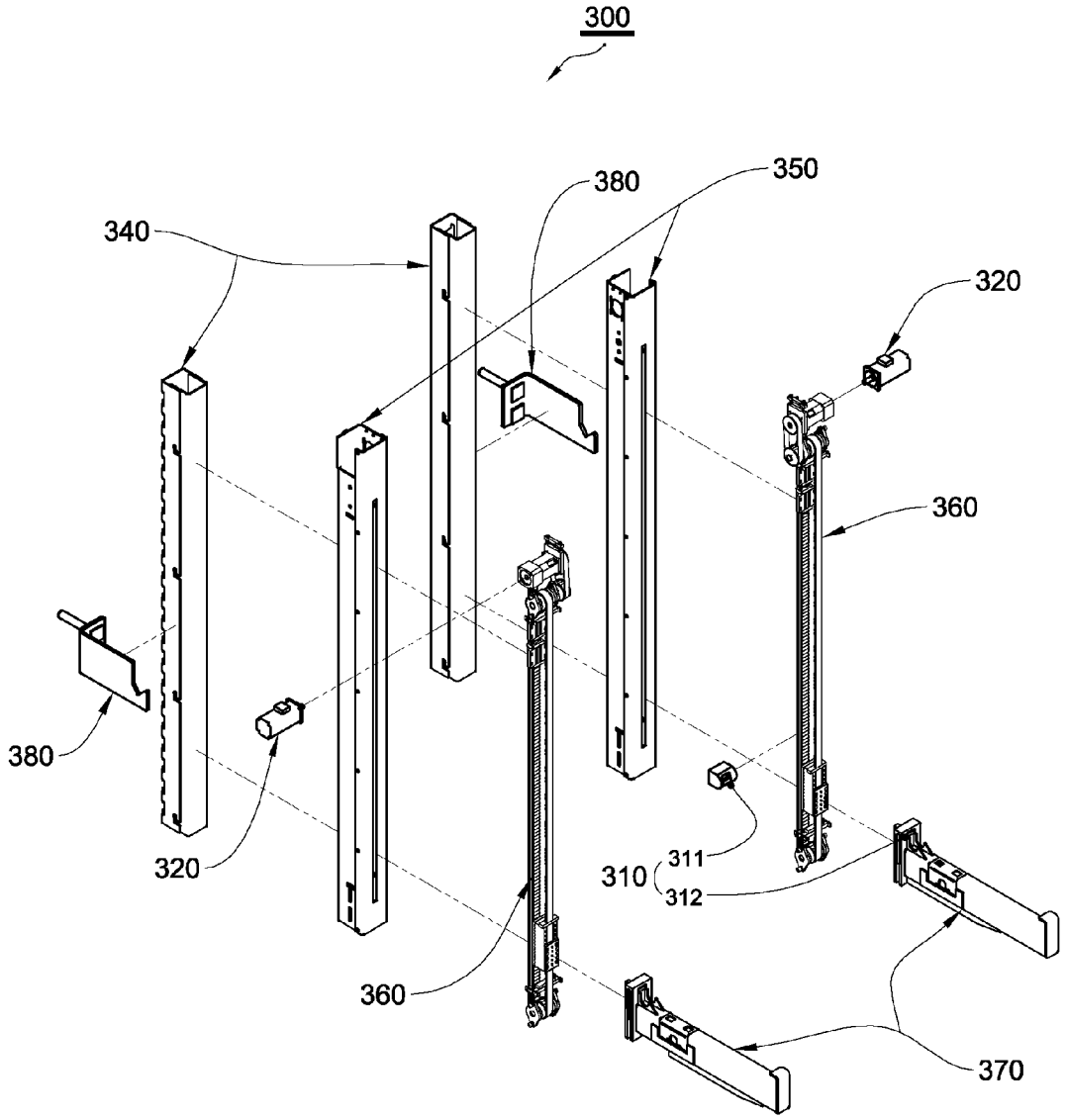
FIG. 3 is an assembled perspective view of the electric exercise spotting device according to the embodiment of the present invention.
Figure 4:
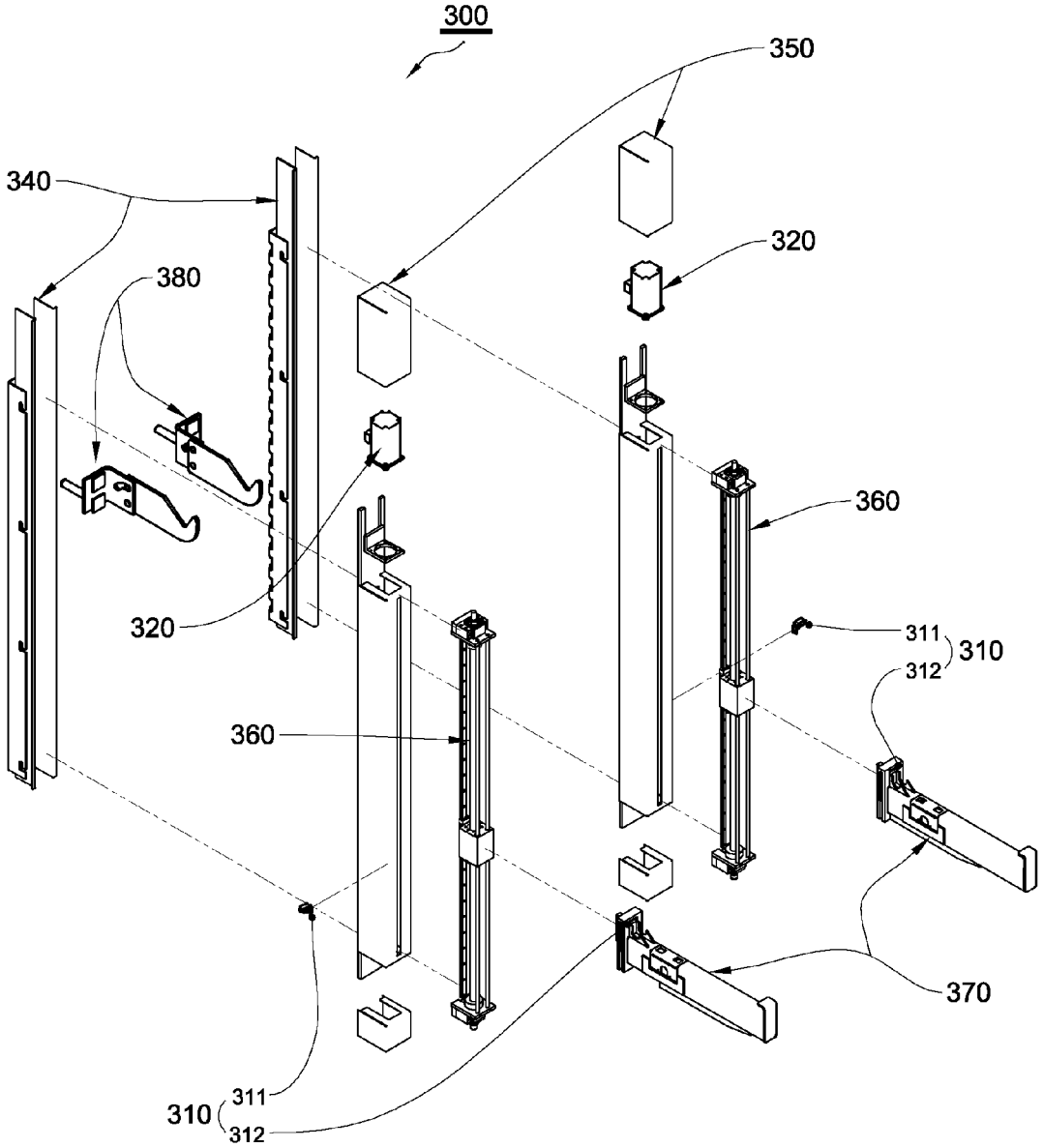
FIG. 4 is an assembled perspective view of the electric exercise spotting device according to another embodiment of the present invention.

FIG. 3 is an assembled perspective view of the electric exercise spotting device according to the embodiment of the present invention, and FIG. 4 is an assembled perspective view of the electric exercise spotting device according to another embodiment of the present invention.

As shown in FIGS. 3 and 4, the electric exercise spotting device 300 according to the embodiment of the present invention includes: sensors 310 having a first sensor 311 for detecting the number of times of exercise and an exercise speed, and a second sensor 312 for detecting that a safety bar approaches an object; a motor 320, driven by a control signal, for generating an external force and transmitting an encoder signal; a microcomputer (not shown) for deriving calculation values of an exercise spotting point, an exercise spotting intensity, and an exercise spotting position on the basis of user information and an exercise intensity, the number of times of exercise and an exercise speed detected by the first sensor 311, and an encoder signal by correcting a driving frictional force inside the exercise spotting device, for calculating an external force value to be generated by the motor 320 based on the calculation values and for sending out a control signal to the motor 320; a mount 340 detachably attached to a vertical frame of a rack 10 used for the muscular strength exercises; a base rail 350, fixed parallel to the mount 340, for guiding movement of the safety bar 370; a power transmission unit 360, positioned inside the base rail 350, for transmitting the power of the motor 320 to the safety bar 370; the safety bar 370 for application of the external force, which is required for exercise spotting and exercise, by receiving the power generated by the motor 320, and for enabling detachment and attachment of a barbell bar for the muscular strength exercises; and a rest 380, fixed to the mount 340 or the base rail 350 in a locking manner, for resting heavy weights, used for the muscular strength exercises, at an exercise starting position.

Accordingly, the electric exercise spotting device 300 according to the embodiment of the present invention is capable of assisting the muscular strength exercises through the safety bar 370 to which an electric actuating power by the motor 320 is transmitted.

The microcomputer receives a signal of the first sensor 311 for detecting the number of times of exercise and an exercise speed, an encoder signal that is transmitted from the motor 320, user information, and an exercise intensity. By receiving information on various and detailed exercise conditions compared to the case when receiving only signals from the sensor, the microcomputer can recognize the exercise conditions more accurately and in detail. By eliminating an additional detecting device such as a load cell and using an encoder incorporated in the motor 320, it is possible to reduce additional devices and instantly grasp the exercise conditions.

Then, the microcomputer derives, by correcting a driving frictional force inside the exercise spotting device, calculation values of an exercise spotting point, an exercise spotting intensity, and an exercise spotting position. Although the amount of the frictional force generated inside the motor 320 and the power transmission unit 360 is smaller than the muscular strength required for exercise or the electric actuating power generated by the motor 320, the influence exerted on the exercise effect is significant in a state that muscles are extremely fatigue. Particularly, since exercise is a hobby activity, not only is the exercise effect important, but also the feeling when doing exercise is also very important. If there is a sense of difference in the spotting device due to a small spotting force difference, the usefulness of the device will be very weakened. The microcomputer of the electric exercise spotting device according to the embodiment of the present invention determines the magnitude of a more accurate spotting external force and a more suitable spotting point and a spotting position through the following steps: calculating a perturbation value using a sliding mode control with sliding perturbation observer (SMCSPO) algorithm based on the signal of the encoder; calculating an external force by subtracting the driving frictional force from the calculated perturbation value, and calculating a final external force follow-up value in which errors have been eliminated by applying the calculated external force to a low-pass filter. Therefore, in the embodiment of the present invention, the exercise spotting by the electric actuating power matches the exercise conditions of the user, so that the exercise effect is doubled, and the sense of difference due to the spotting device is reduced.

Also, the microcomputer of the electric exercise spotting device according to the embodiment of the present invention not only calculates the external force value to be generated by the motor 320 to assist the muscular strength exercises using the heavy weights, but also, after the barbell bar 21 is rested and fixed to the safety bar 370, calculates the external force value to be generated by the motor 320 to assist the muscular strength exercises being performed against a load for the muscular strength exercises, the load generated in the barbell bar 21 by the power of the motor 320.

Therefore, the electric exercise spotting device according to the embodiment of the present invention can both perform and assist the muscular strength exercises using the heavy weights and the muscular strength exercises using the load generated by the electric actuating power.

Figure 5:
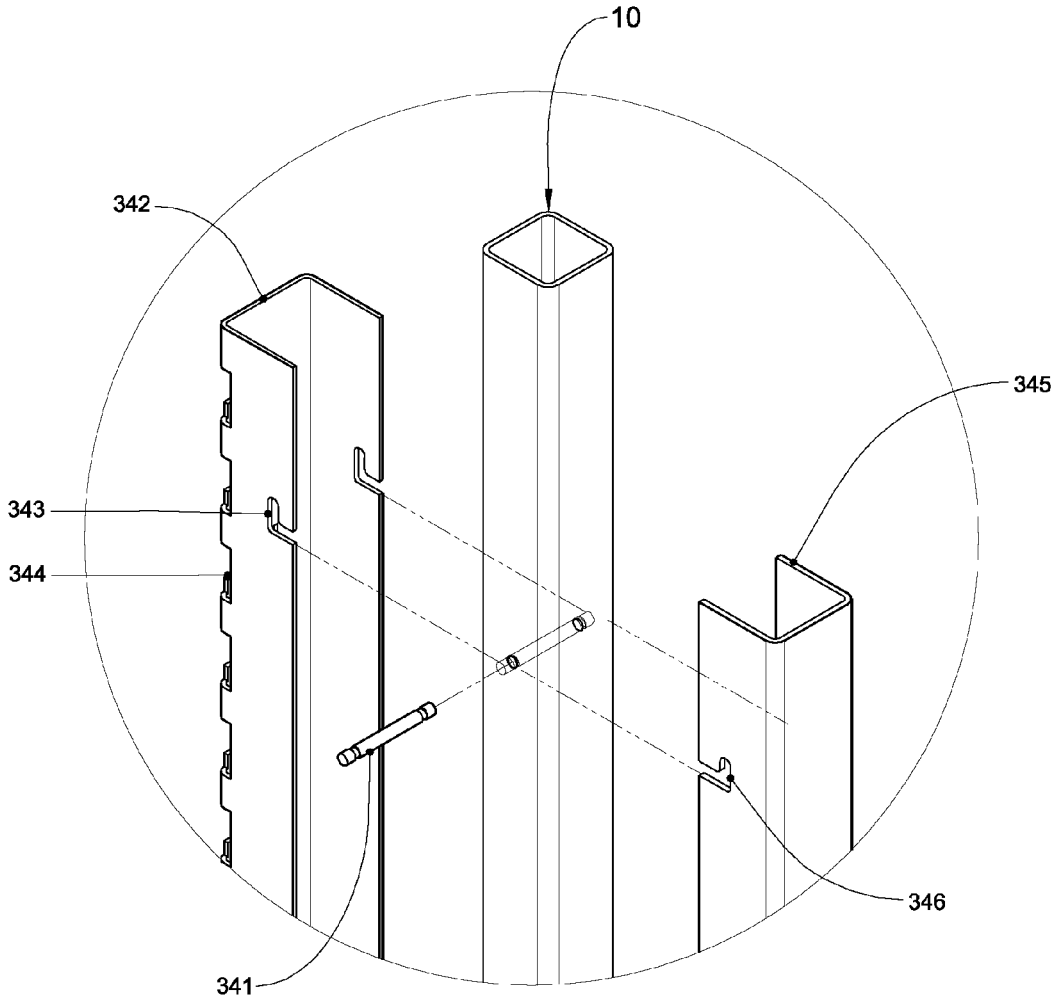
FIG. 5 is an assembled perspective view of a mount of the electric exercise spotting device according to the embodiment of the present invention.

FIG. 5 is an assembled perspective view of a mount of the electric exercise spotting device according to the embodiment of the present invention.

As shown in FIG. 5, the mount 340 of the electric exercise spotting device 300 according to the embodiment of the present invention includes: a rod-shaped mounting pin 341 which is installed through the vertical frame of the rack 10 used for the muscular strength exercises; a first mount 342 in the shape of a U-beam provided with a first locking groove 343 with which the mounting pin 341 is engaged and a rest groove 344 with which the rest 380 is engaged; and a second mount 345 in the shape of a U-beam to which the base rail 350 is fixed and provided with a second locking groove 346 with which the mounting pin 341 is engaged.

Therefore, the electric exercise spotting device according to the embodiment of the present invention can be attached to any existing rack, if a hole through which the mounting pin 341 is to be passed is once drilled in the vertical frame of the rack 10 used for the muscular strength exercises.

Figure 6:
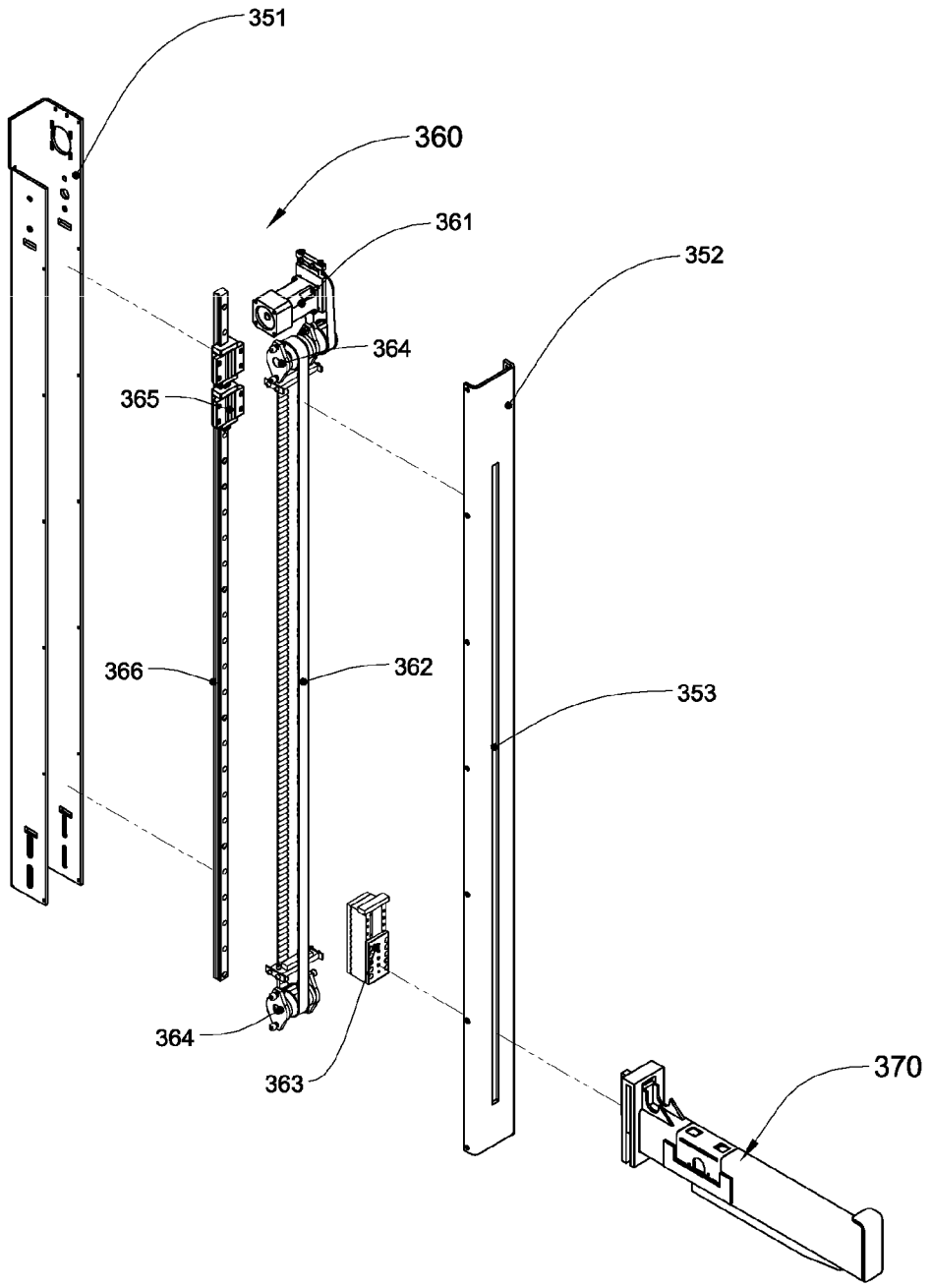
FIG. 6 is an assembled perspective view of a base rail, a power transmission unit, and a safety bar of the electric exercise spotting device according to the embodiment of the present invention.
Figure 7:
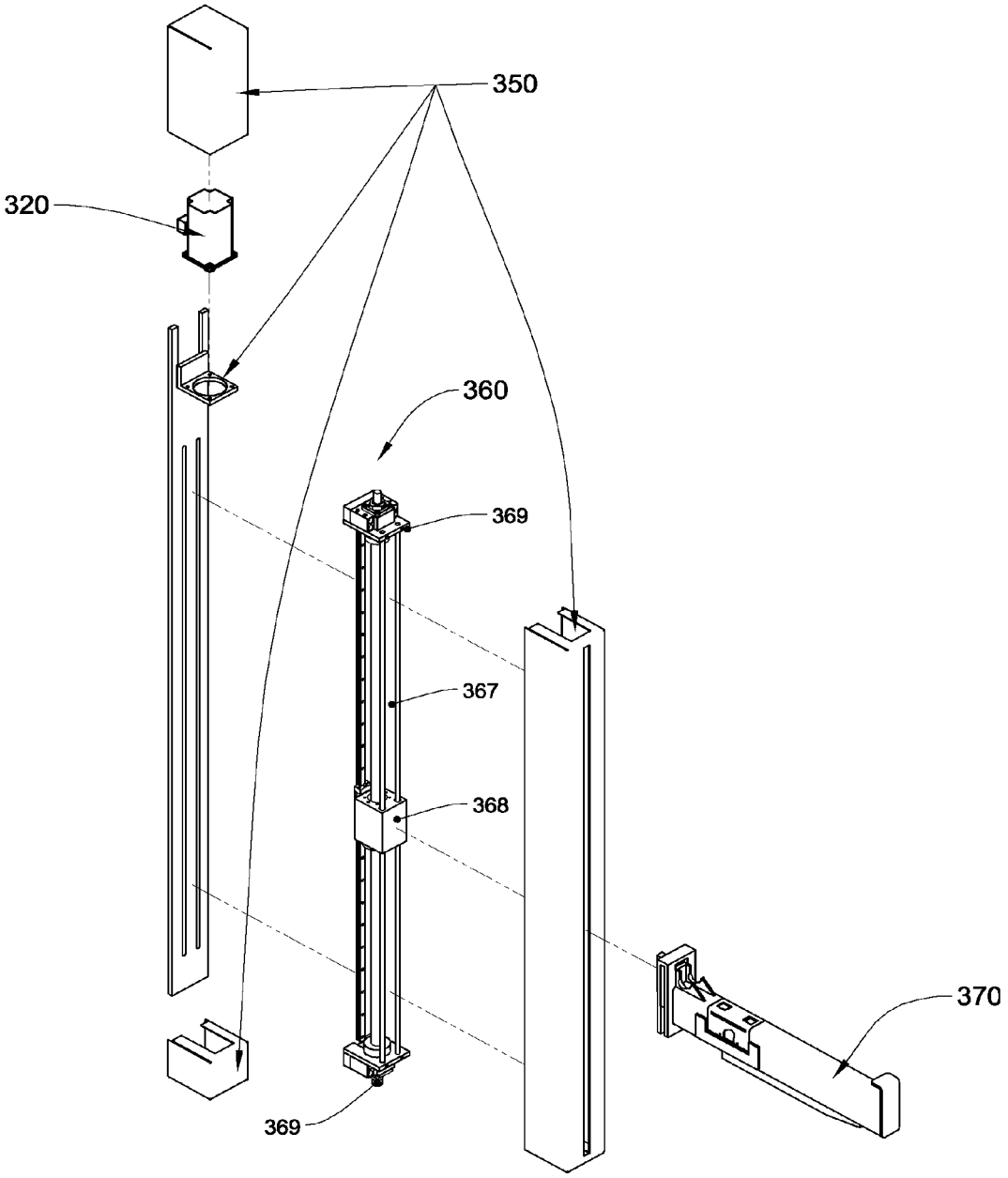
FIG. 7 is an assembled perspective view of a base rail, a power transmission unit, and a safety bar of the electric exercise spotting device according to another embodiment of the present invention.

FIG. 6 is an assembled perspective view of a base rail, a power transmission unit, and a safety bar of the electric exercise spotting device according to the embodiment of the present invention, and FIG. 7 is an assembled perspective view of a base rail, a power transmission unit, and a safety bar of the electric exercise spotting device according to another embodiment of the present invention.

As shown in FIG. 6, the base rail 350 of the electric exercise spotting device 300 according to the embodiment of the present invention includes: a first rail main body 351 in the shape of a U-beam fixed to the mount 340; and a second rail main body 352 in the shape of a U-shaped beam in which a rail groove 353 for guiding the movement of the safety bar 370 is vertically formed.

In addition, the power transmission unit 360 of the electric motor assist device 300 according to the embodiment of the present invention includes: a motor connector 361, connected to a drive shaft of the motor 320, for initially receiving the power of the motor 320; a belt 362 for transmitting the power transmitted to the motor connector 361 to the safety bar 370; a safety bar connector 363 fixed on the belt 362 and coupled with the safety bar 370; pulleys 364, positioned at upper and lower portions of the belt 362 for stabilizing the driving of the belt; a weight balancer 365, fixed on the belt 362, for smoothing the driving of the belt 362 and the motor 320 by canceling out a weight of the safety bar 370 by its own weight and an external force by the exercise spotting and its own weight; and a weight balancer rail 366 installed in a direction parallel to the belt 362 for guiding movement of the weight balancer 365.

The safety bar 370 of the electric exercise spotting device 300 according to the embodiment of the present invention assists the muscular strength exercises while performing a vertical movement along the rail groove 353 formed in the base rail 350. The power transmission unit 360 is disposed inside the base rail 350 and transmits power generated by the motor 320 to the safety bar 370. Also, the power transmission unit 360 includes a weight balancer 365 and a weight balancer rail 356 to smooth the driving of the safety bar 370 by canceling out the external force by the weight of the safety bar 370 and the exercise spotting. It is preferable that the weight balancer 365 and the weight balancer rail 366 are installed on a rear surface side of the power transmission unit 360 provided that the surface on which the safety bar 370 is installed is a front surface of the power transmission unit 360

As shown in FIG. 7, the base rail 350 of the electric exercise spotting device 300 according to another embodiment of the present invention is formed in the shape of a rectangular tube, the front of which the rail groove 353 for guiding the movement of the safety bar 370 is vertically formed.

In addition, the power transmission unit 360 of the electric exercise spotting device 300 according to another embodiment of the present invention includes: a motor connector 361, connected to a drive shaft of the motor 320, for initially receiving the power of the motor 320; a ball screw 367, vertically connected to the motor connector 361, for being rotated according to the driving of the motor 320; a ball screw nut 368 positioned on the threads of the ball screw 367 and engaged with the safety bar 370; and rotation supports 369 positioned upper and lower parts of the ball screw 367 to form a rotation axis of the ball screw 367.

The safety bar 370 of the electric exercise spotting device 300 according to another embodiment of the present invention assists the muscular strength exercises while performing a vertical movement along the rail groove 353 formed in the base rail 350. The power transmission unit 360 is disposed inside the base rail 350, includes a ball screw 367 and a ball screw nut 368, and transmits power generated by the motor 320 to the safety bar 370 in a screw-type. The screw-type power transmission has the advantage of transmitting power more accurately and precisely.

Figure 8:
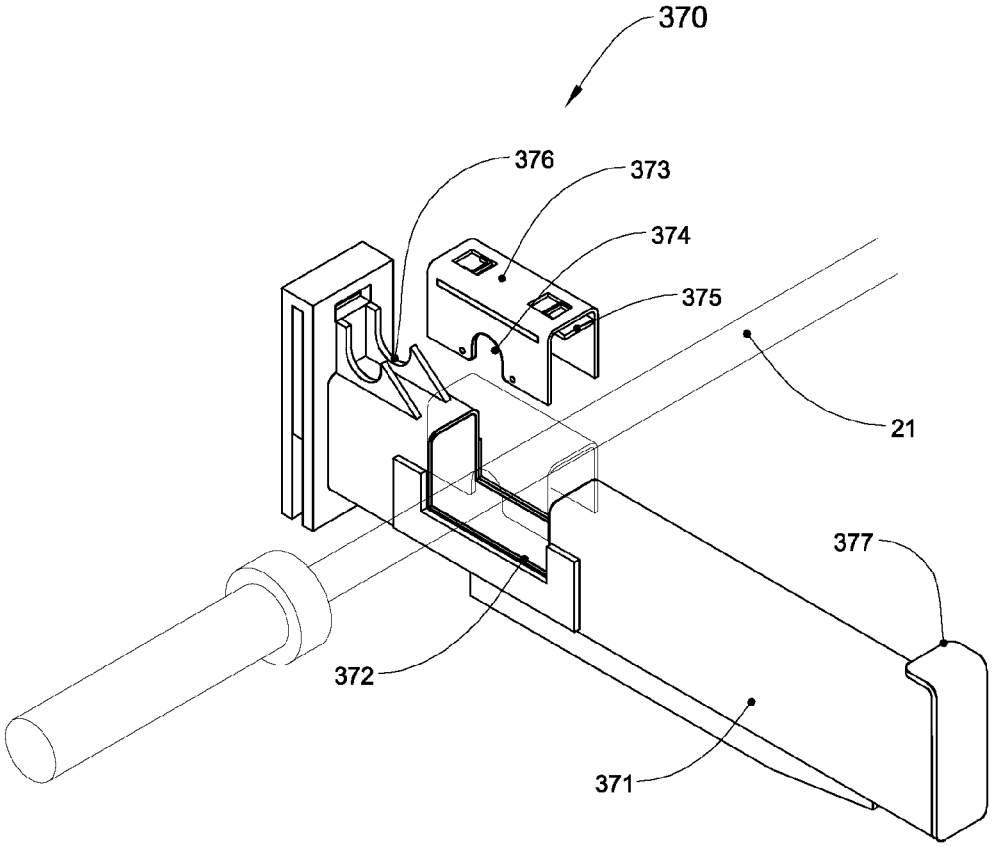
FIG. 8 is an assembled perspective view of the safety bar of the electric exercise spotting device according to the embodiment of the present invention.

FIG. 8 is an assembled perspective view of the safety bar of the electric exercise spotting device according to the embodiment of the present invention.

As shown in FIG. 8, the safety bar 370 of the electric exercise spotting device 300 according to the embodiment of the present invention includes: a safety bar main body 371, coupled to the power transmission unit 360, for receiving the power of the motor 320 and for transmitting an external force by the muscle strength exercise to the power transmission unit 360 and the motor 320, and having a rectangular tubular shape with an upper side thereof being cut out to have a safety bar cap fixing groove 372; a safety bar cap 373 capable of being detachably attachable to the safety bar cap fixing groove 372 and provided with a bar fixing groove 374 in which the barbell bar 21 used for the muscular strength exercises is seated thereunder; an impact-reducing material, installed on a upper surface of the safety bar 370 for reducing impact generated when the safety bar 370 touches a heavy weight used for the muscular strength exercises; and a separation-preventing protrusion 377 for preventing the barbell bar 21 from falling out of the safety bar 370 and falling down at the distal end of the safety bar 370, thereby performing both of the muscular strength exercises using the heavy weight and the muscular strength exercises using the power of the motor.

Therefore, in the electric exercise spotting device 300 according to the embodiment of the present invention, the barb rod 21 is fixed to the safety bar 370, so that it is possible to perform and assist the muscular strength exercises using the load generated by the electric actuating power. The safety bar 370 may perform a role in assisting the muscular strength exercises using heavy weights, in the case the barbell bar 21 is fixed to the safety bar 370, it is possible to perform and assist the muscular strength exercises using the load generated by the electric actuating power. The safety bar cap 373 is provided with a safety bar cap latch 375, so that it is possible to easily detach the safety bar cap 373 from the safety bar main body 371.

FIGS. 9A to 9D are explanatory views of a lift function of the electric exercise spotting device according to the embodiment of the present invention.

As shown in FIGS. 9A to 9D, the safety bar 370 of the electric exercise spotting device 300 according to the embodiment of the present invention includes a barbell bar rest groove 376, in the shape of a groove, into which the barbell bar 21 is inserted such that the barbell bar 21 is not moved on the safety bar 370, and performs a lift function for moving the heavy weight used for the muscular strength exercises to an exercise starting position for each type of the muscular strength exercises.

Figure 9A:
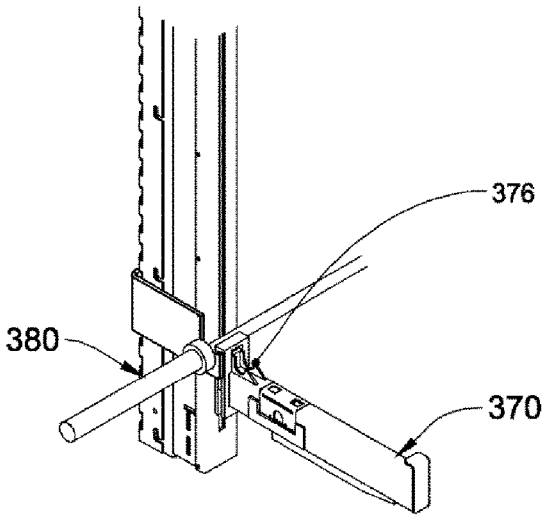
FIGS. 9A to 9D are explanatory views of a lift function of the electric exercise spotting device according to the embodiment of the present invention.
Figure 9B:
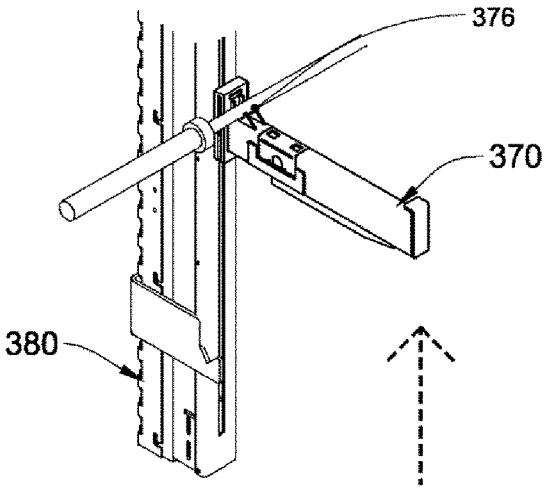
Figure 9C:
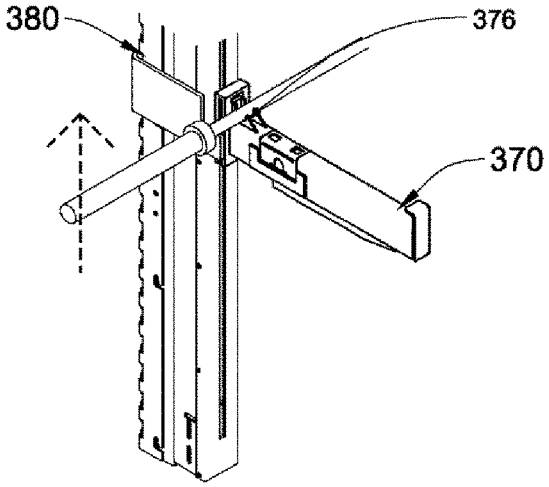
Figure 9D:
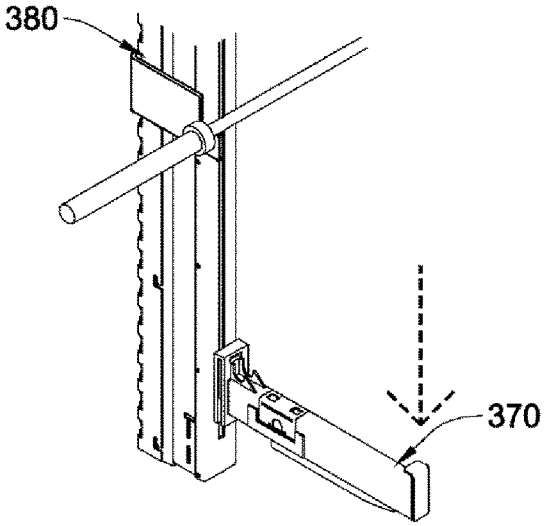

The lift function of the electric exercise spotting device 300 according to the embodiment of the present invention can be performed through the following steps: <FIG. 9A>Positioning an initial weight—<FIG. 9B>Lifting a safety bar—<FIG. 9C>Changing the position of a rest—<FIG. 9D>Lowering a safety bar, which are shown in FIGS. 9A to 9D.

FIGS. 10A to 10D are explanatory views of a lift function of the electric exercise spotting device according to another embodiment of the present invention.

As shown in FIGS. 10A to 10D, the rest 380 of the electric exercise spotting device 300 according to the embodiment of the present invention includes: a frame latching portion 381 for fixing the rest 380 to the mount 340 to the base rail 350 in a latching manner; a barbell rest 382 provided with a mounting groove on which the barbell bar 21 is rested; and an one-way hinge 383 for allowing vertical rotation of the barbell rest 382 with respect to the frame fixing portion 381, the one-way hinge being rotatable in an upward direction and restricted to rotate in a downward direction by a hinge stop.

Figure 10A:
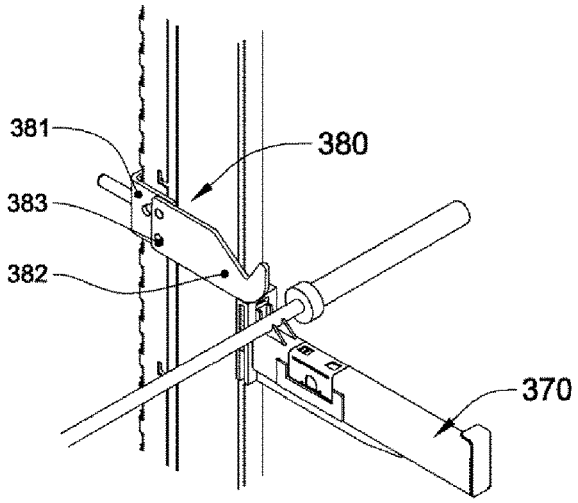
FIGS. 10A to 10D are explanatory views of a lift function of the electric exercise spotting device according to another embodiment of the present invention.
Figure 10B:
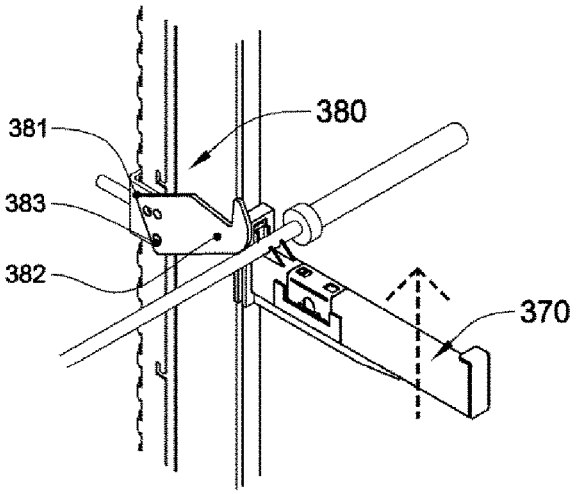
Figure 10C:
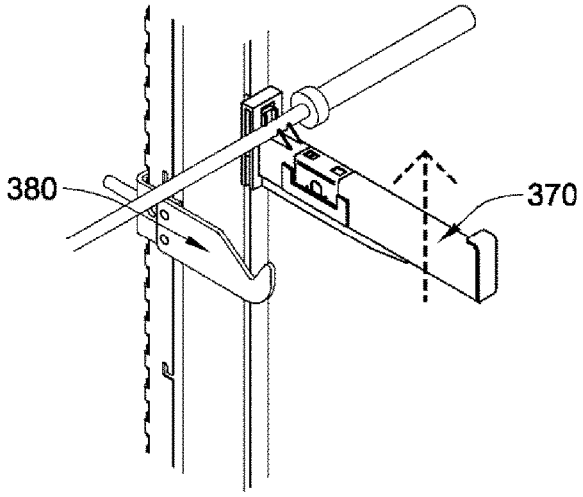
Figure 10D:
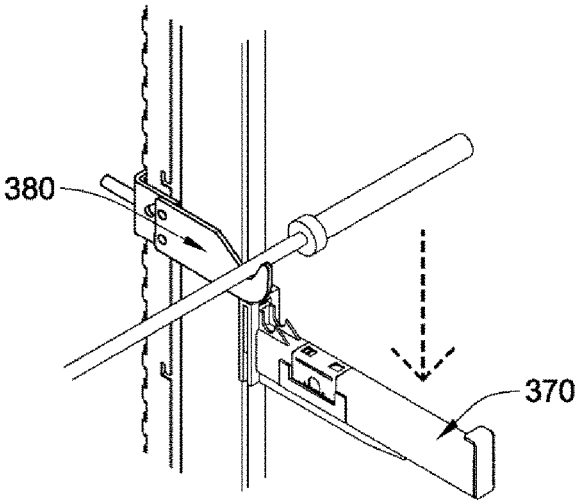

The lift function of the electric exercise spotting device 300 according to another embodiment of the present invention can be performed through the following steps: <FIG. 10A>Changing the position of a rest to a starting position—<FIG. 10B>Upward rotation of a barbell bar rest due to lift of a safety bar—<FIG. 10C>Lifting a barbell bar above the rest—<FIG. 10D>Resting of the barbell bar according to lowering the safety bar and the restriction of the downward rotation of the barbell bar rest, which are shown in FIGS. 10A to 10D.

Such a lift function is derived from the fact that the initial position of the heavy weight becomes different depending on various kinds of muscle strength exercises. For example, it is advantageous for the bench press to start exercising with the heavy weight rested at waist height, and it is advantageous for the squat to start exercising with the heavy weight rested at shoulder height. Since it is difficult and complicated to move the heavy weight to the starting position alone, moving the heavy weight by means of the electric actuating power increases the exercise efficiency when switching a type of exercise.

Figure 11A:
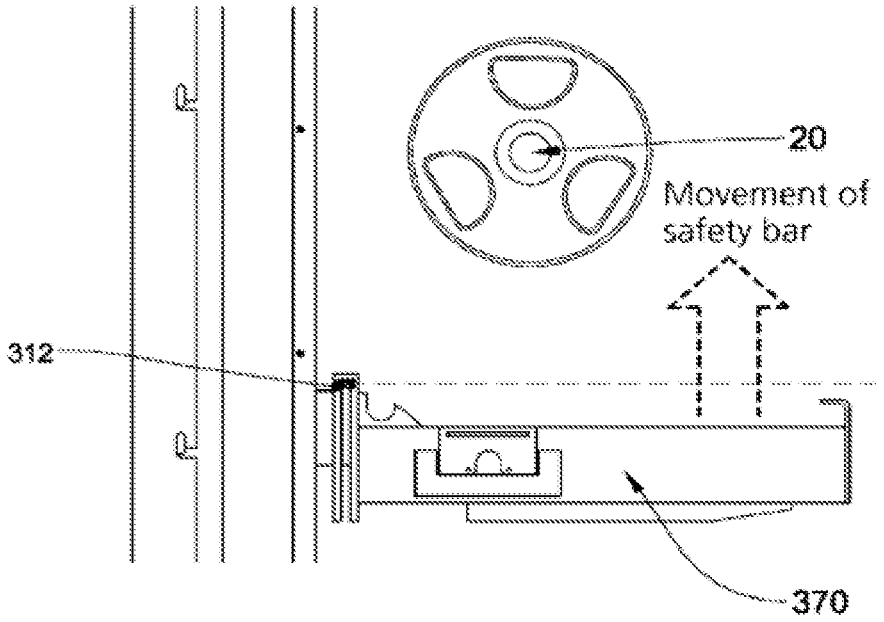
FIGS. 11A and 11B are explanatory views showing operation of a second sensor of the electric exercise spotting device according to the embodiment of the present invention.
Figure 11B:
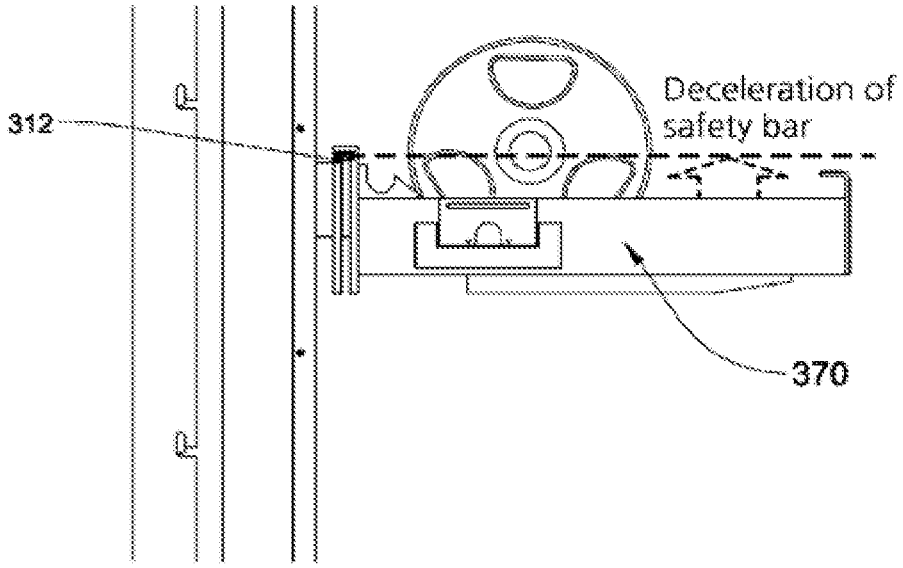

FIGS. 11A and 11B are explanatory views showing operation of a second sensor of the electric exercise spotting device according to the embodiment of the present invention.

As shown in FIGS. 11A and 11B, the second sensor 312 of the electric exercise spotting device 300 according to the embodiment of the present invention is fixed to the safety bar 370 to detect the approach of an upper side surface of the safety bar 370 to the object, whereby when the upper side surface of the safety bar 370 approaches the object, the moving speed of the safety bar 370 is reduced.

Therefore, the second sensor 312 of the electric exercise spotting device 300 according to the embodiment of the present invention, when the safety bar 370 is moved so that the upper side surface of the safety bar 370 is brought into contact with the object, reduces the impact caused by the contact. It is preferable that the deceleration of the safety bar 370 by the second sensor 312 is more decelerated in the late period of deceleration than in the initial period of deceleration.

The present invention has a purpose to reduce a sense of difference occurring when assisting the muscular strength exercises by means of the electric actuating power. However, such a sense of difference occurs when the power transmission device directly contacts the user or the exercise device that the user uses. In particular, the first external stimulus, at the time that an initial contact occurs, causes the greatest sense of difference. For this reason, the second sensor 312 of the electric exercise spotting device 300 according to the embodiment of the present invention is installed for the purpose of reducing the sense of difference that occurs when the exercise spotting device directly comes into contact with the user.

As described above, the electric exercise spotting device according to the embodiment of the present invention includes: sensors having a first sensor and a second sensor; a motor, driven by means of a control signal, for generating an external force; a microcomputer for deriving calculation values of an exercise spotting point, an exercise spotting intensity, and an exercise spotting position on the basis of user information and an exercise intensity, the number of times of exercise and an exercise speed detected by the first sensor, and an encoder signal by correcting a driving frictional force inside the exercise spotting device; a mount detachably attached to a vertical frame of a rack used for the muscular strength exercises; a base rail for guiding movement of a safety bar; a power transmission unit for transmitting the power of the motor to the safety bar; the safety bar for application of the external force, which is required for exercise spotting and exercise, and for enabling detachment and attachment of a barbell bar for the muscular strength exercises; and a rest for resting heavy weights, used for the muscular strength exercises, at an exercise starting position. Accordingly, it is understood that the basic technical idea of the present invention is to provide an exercise spotting device that can be installed in addition to the rack for weight training, that can be suitable for a sensitive reaction that muscles exhibit in a fatigue state, and that can perform and assist both of the muscular strength exercises using the heavy weights and the muscular strength exercises using a load generated by an electric actuating power.

The embodiments and the accompanying drawings described in the present specification are merely illustrative of some of the technical ideas included in the present invention. Therefore, the embodiments disclosed herein are not for the purpose of limiting the technical ideas of the present invention, but rather of describing the present invention, so it is obvious that the invention is not limited to the disclosed embodiments. It should be interpreted that various modifications and specific embodiment from which those skilled in the art may derive are included within the scope of the present invention.

The invention claimed is:

1. An electric exercise spotting device for assisting muscular strength exercises, provided with a safety bar driven by a motor for exercise spotting, the electric exercise spotting device comprising:

sensors comprising a first sensor for detecting the number of times of exercise and an exercise speed, and a second sensor for detecting that the safety bar approaches an object;

a motor, driven by a control signal, for generating an external force and transmitting an encoder signal;

a microcomputer for deriving calculation values of an exercise spotting point, an exercise spotting intensity, and an exercise spotting position on the basis of user information and an exercise intensity, the number of times of exercise and an exercise speed detected by the first sensor, and an encoder signal by correcting a driving frictional force inside the exercise spotting device, for calculating an external force value to be generated by the motor based on the calculation values, and for sending out a control signal to the motor;

a mount detachably attached to a vertical frame of a rack used for the muscular strength exercises;

a base rail, fixed parallel to the mount, for guiding movement of the safety bar;

a power transmission unit, positioned inside the base rail, for transmitting the power of the motor to the safety bar;

the safety bar for application of the external force, which is required for exercise spotting and exercise, by receiving the power generated from the motor, and for enabling detachment and attachment of a barbell bar for the muscular strength exercises; and a rest, fixed to the mount or the base rail in a locking manner, for resting heavy weights, used for the muscular strength exercises, at an exercise starting position;

wherein the mount comprises a rod-shaped mounting pin which is installed through the vertical frame of the rack used for the muscular strength exercises; a first mount in the shape of a U-beam provided with a first locking groove with which the mounting pin is engaged and a rest groove with which the rest is engaged; and a second mount in the shape of a U-beam to which the base rail is fixed and provided with a second locking groove with which the mounting pin is engaged.

2. The electric exercise spotting device according to claim 1, wherein the base rail is formed in the shape of a rectangular tube with a rail groove for guiding the movement of the safety bar vertically formed on the front surface.

3. The electric exercise spotting device according to claim 1, wherein the power transmission unit comprises: a motor connector, connected to a drive shaft of the motor, for initially receiving the power of the motor; a belt for transmitting the power transmitted to the motor connector to the safety bar; a safety bar connector fixed on the belt and coupled with the safety bar; pulleys, positioned at upper and lower portions of the belt for stabilizing the driving of the belt; a weight balancer, fixed on the belt, for smoothing the driving of the belt and the motor by canceling out a weight of the safety bar by its own weight and an external force by the exercise spotting and its own weight; and a weight balancer rail installed in a direction parallel to the belt for guiding movement of the weight balancer.

4. The electric exercise spotting device according to claim 1, wherein the power transmission unit comprises: a motor connector, connected to a drive shaft of the motor, for initially receiving the power of the motor; a ball screw, vertically connected to the motor connector, for being rotated according to the driving of the motor; a ball screw nut positioned on the threads of the ball screw and engaged with the safety bar; and rotation supports positioned upper and lower parts of the ball screw to form a rotation axis of the ball screw.

5. The electric exercise spotting device according to claim 1, wherein the safety bar comprises: a safety bar main body, coupled to the power transmission unit, for receiving the power of the motor and for transmitting an external force by the muscle strength exercise to the power transmission unit and the motor, and having a rectangular tubular shape with an upper side thereof being cut out to have a safety bar cap fixing groove; a safety bar cap capable of being detachably attachable to the safety bar cap fixing groove and provided with a bar fixing groove in which the barbell bar used for the muscular strength exercises is seated thereunder; and an impact-reducing material, installed on a upper surface of the safety bar for reducing impact generated when the safety bar touches a heavy weight used for the muscular strength exercises, thereby performing both of the muscular strength exercises using the heavy weight and the muscular strength exercises using the power of the motor, wherein the safety bar further comprises a barbell bar rest groove, in the shape of a groove, into which the barbell bar is inserted such that the barbell bar is not moved on the safety bar, and performs a lift function for moving the heavy weight used for the muscular strength exercises to an exercise starting position for each type of muscular strength exercises.

6. The electric exercise spotting device according to claim 1, wherein the rest comprises: a frame latching portion for fixing the rest to the mount or the base rail in a latching manner; a barbell rest provided with a mounting groove on which the barbell bar is rested; and an one-way hinge for allowing vertical rotation of the barbell rest with respect to the frame fixing portion, the one-way hinge being rotatable in an upward direction and restricted to rotate in a downward direction by a hinge stop.

7. The electric exercise spotting device according to claim 1, wherein the second sensor is fixed to the safety bar to detect the approach of an upper side surface of the safety bar to the object, whereby when the upper side surface of the safety bar approaches the object, the moving speed of the safety bar is reduced.

8. The electric exercise spotting device according to claim 5, wherein the microcomputer not only calculates the external force value to be generated by the motor to assist the muscular strength exercises using the heavy weight, but also, after the barbell bar is rested and fixed between the safety bar main body and the safety bar cap, calculates the external force value to be generated by the motor to assist the muscular strength exercises being performed against a load for the muscular strength exercises, the load generated in the barbell bar by the power of the motor.

* * * * *